United States Patent [19]

Sweet

[11] 3,975,141

[45] Aug. 17, 1976

[54] COMBUSTION LINER SWIRLER

[75] Inventor: Ervin Jack Sweet, Trumbull, Conn.

[73] Assignee: The United States of America as represented by the Secretary of the Army, Washington, D.C.

[22] Filed: June 25, 1974

[21] Appl. No.: 482,945

[52] U.S. Cl. ..... 431/352; 431/353; 60/39.74 R; 431/182; 239/406

[51] Int. Cl.[2] ..... F02C 3/24; F23R 1/10

[58] Field of Search ..... 431/351–353, 431/173, 182, 185; 60/39.74 R; 239/405, 406

[56] References Cited

UNITED STATES PATENTS

| | | | |
|---|---|---|---|
| 1,740,985 | 12/1929 | Irish | 431/185 |
| 2,274,818 | 3/1942 | Zink | 431/182 |
| 2,654,219 | 10/1953 | Zaba | 60/39.65 |
| 2,753,925 | 7/1956 | Campbell et al. | 431/353 |
| 2,973,032 | 2/1961 | Reilly et al. | 431/185 |
| 3,349,826 | 10/1967 | Poole et al. | 239/406 |
| 3,408,154 | 10/1968 | Bachi, Jr. | 431/353 |
| 3,608,831 | 9/1971 | Place | 60/39.74 R |
| 3,648,457 | 3/1972 | Bobo | 60/39.74 R |
| 3,694,135 | 9/1972 | Dancy et al. | 431/351 |
| 3,831,854 | 8/1974 | Sato et al. | 239/406 |
| 3,845,903 | 11/1974 | Runninger | 431/351 |
| 3,853,456 | 12/1974 | Mutchler | 431/353 |
| 3,922,137 | 11/1975 | Peczeli et al. | 431/353 |

*Primary Examiner*—John J. Camby
*Assistant Examiner*—Henry C. Yuen
*Attorney, Agent, or Firm*—Peter A. Taucher; John E. McRae; Nathan Edelberg

[57] ABSTRACT

In the use of combustion apparatus with hot gas turbines it is desirable to be able to efficiently burn fuel at widely ranging rates (pounds per hour) in accordance with varying demands on the turbine. The present invention proposes a combustor wherein stable combustion is achieved over a wide range of fuel flows. Combustion air is introduced as a circumferential swirl around the sprayed fuel to promote a high tangential velocity and low core velocity.

1 Claim, 4 Drawing Figures

Fig-2
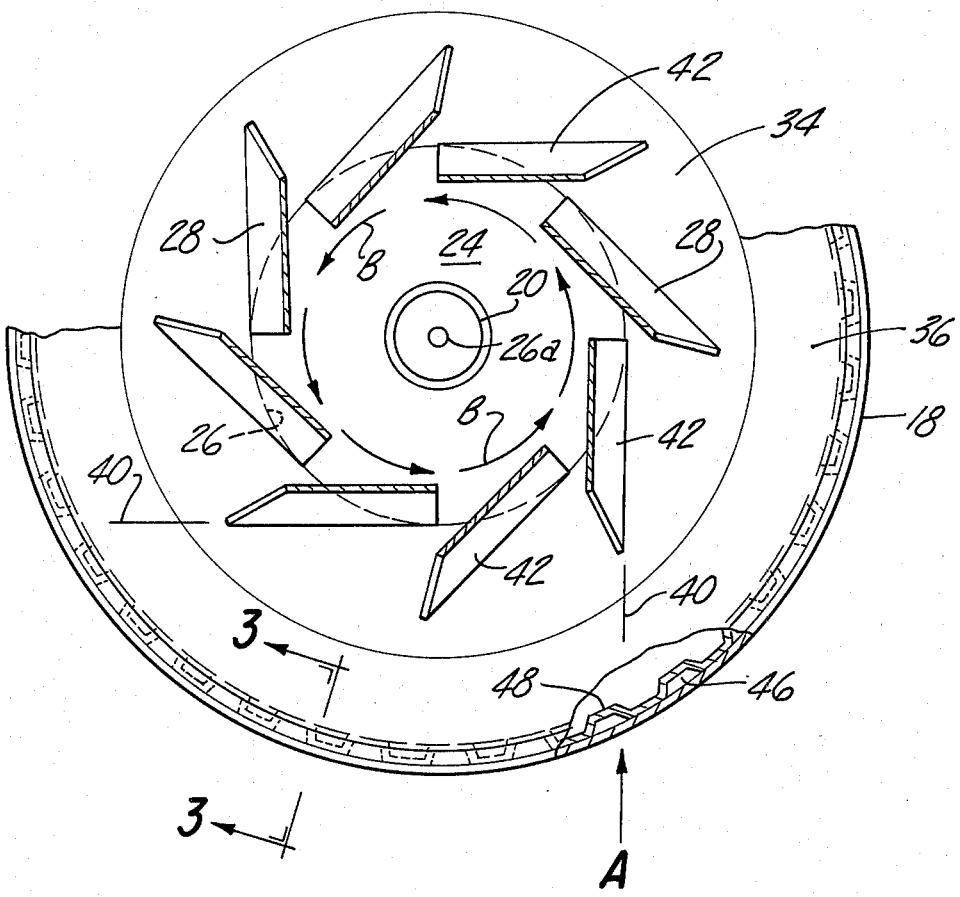
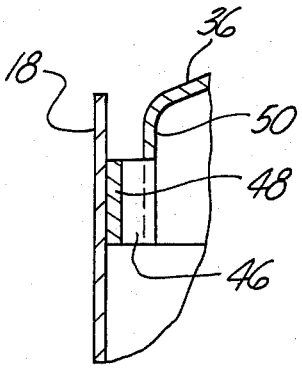
Fig-3
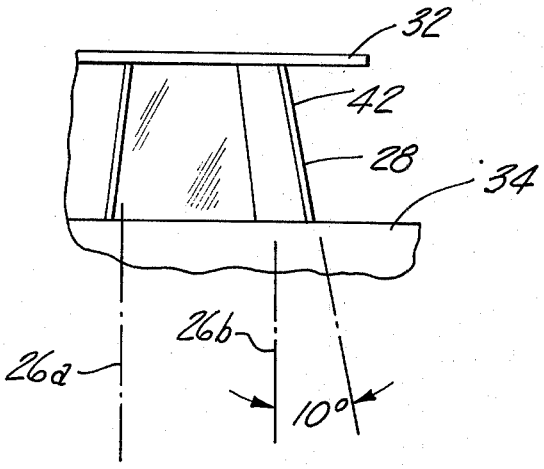
Fig-4

COMBUSTION LINER SWIRLER

THE INVENTION

The invention proposes a combustion apparatus wherein pressurized combustion air is introduced to a spin chamber which leads to a restricted throat opening in the end wall of a combustion tube. Kerosene or similar liquid fuel is sprayed through the spin chamber into the throat opening for intermixture with the spinning air stream. The throat opening has a relatively small diameter for accelerating the spinning air to a relatively high linear velocity, thereby promoting intermixture of the air and fuel particles.

THE DRAWINGS

FIG. 2 is an enlarged sectional view taken on line 2—2 in FIG. 1.

FIG. 3 is a fragmentary sectional view taken on line 3—3 in FIG. 2.

FIG. 4 is a fragmentary elevational view taken in the direction of arrow A in FIG. 2.

THE DRAWINGS IN DETAIL

Figure 1:
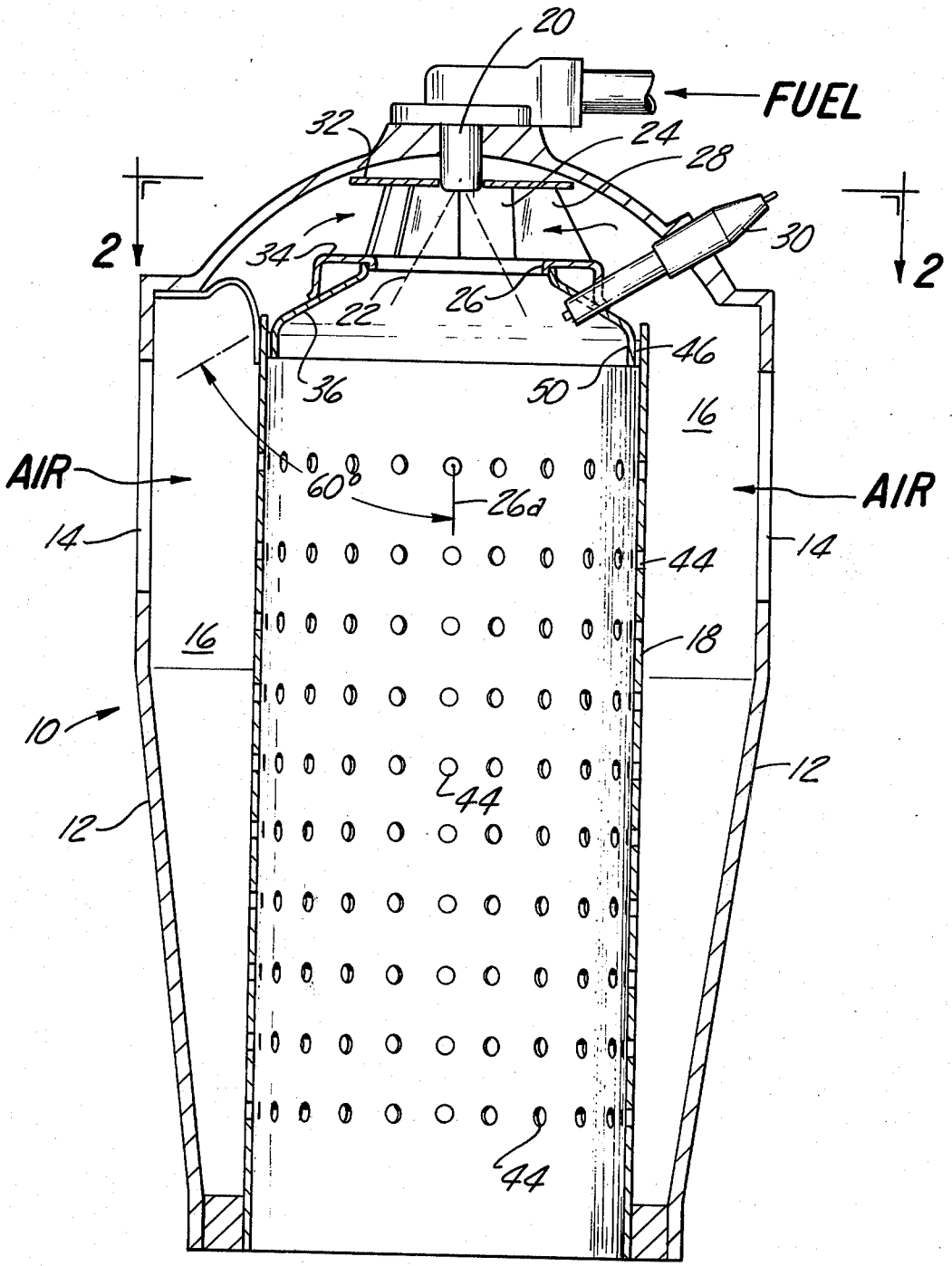
FIG. 1 is a longitudinal sectional view taken through a combustion apparatus embodying the invention.

FIG. 1 illustrates a combustion apparatus 10 comprising an outer housing 12 having one or more openings 14 for admitting high pressure air to space 16 surrounding combustion tube 18. The air might be pressurized to a value in the range of 100–150 p.s.i.

Liquid fuel, such as kerosene, is supplied at relatively high pressure, e.g. 250 p.s.i., through a spray nozzle 20; the conical spray pattern of the nozzle is identified by numeral 22. During its travel from nozzle 20 into combustion tube 18 the liquid fuel passes through a spin chamber 24 and a restricted throat opening 26. Spin chamber 24 is open at its outer periphery to accept pressurized air from space 16.

Pressurized air flows from space 16 into chamber 24 through tangential passages defined by spin vanes 28 at the outer periphery of the chamber. The vanes impart a circumferential spin to the air as denoted by arrows B in FIG. 2. Eventually the spinning air particles are exhausted from chamber 24 through throat opening 26 and thence into the interior of combustion tube 18. The air experiences an acceleration in its linear velocity as it spins through throat opening 26. At approximately the moment of its highest velocity (in throat opening 26) the air mixes with the fuel spray 22 to form a combustible mixture. Combustion takes place in tube 18 downstream from throat opening 26. A spark plug 30 is provided for initial start-up.

Spin chamber 24 may be suitably formed to include an upper end wall 32 and a lower end wall 34. End wall 32 is provided with a central clearance opening to receive fuel nozzle 20. End wall 34 is formed with a central circular flange that forms the aforementioned throat structure 26. Wall 34 is mounted atop the frustro-conical end wall 36 that closes the combustion tube 18.

As shown in FIG. 2, there are eight evenly spaced vanes 28 arranged in a ring-like pattern at the outer periphery of spin chamber 24. FIG. 2 is a sectional view taken in a radial plane passing through the upper edge areas of the vanes; the upper edges of the vanes are shown in cross section. As seen in FIG. 2, the vanes are flat and tangent to circular opening 26, as denoted by directional lines 40. As seen in FIG. 4, the vanes are slightly tilted relative to an imaginary line **26*b* paralleling the central axis 26*a* of opening 26. This slight tilt of about ten degrees causes the outer faces 42 of the vanes to be visible in FIG. 2. As viewed in FIG. 1, each vane has a trapezoidal configuration such that the length of the vane in the direction of air flow is greater at wall 34 than at wall 32.**

The tangential direction 40 taken by the vanes causes the pressurized air to have a high tangential velocity component as it enters chamber 24. The vanes are located radially outward from throat opening 26 so that the tangential velocity components are generated before the air is in axial registry with the throat opening. The aim is to ensure that the air will have a spinning motion about axis **26*a* as it moves through opening 26.**

The slight ten degree tilt of the vanes provides an axial flow component of relatively small magnitude, sufficient to provide a satisfactory throughput of air for ensuring continued combustion in tube 18.

By reference to FIG. 1 it can be visualized that when fuel and air particles approach the mixing zone defined by the throat opening 26 the fuel particles is spray 22 will be moving primarily in axial directions, whereas the spinning air particles will be moving in circumferential directions. Apparently the fuel particles undergo a substantial change in direction as they are assimilated into the spinning air stream, thereby promoting a fine atomization of the fuel particles. The pressurized condition of the air and the progressive influx of air into the swirl chamber causes the air particles to experience relatively high linear accelerations during their movements from space 16 into opening 26. The high linear velocity of the spinning air is believed to promote intermixture of the air and fuel particles.

End wall 36 of the combustion tube radiates outwardly from throat opening 26 at an angle of approximately 60° relative to the tube axis **26*a*. Therefore, the fuel-air mixture undergoes a rapid deceleration as it moves from opening 26 into the combustion tube 18. In addition, the high swirl velocity creates a rapid expansion of air along the end wall 36 and primary zone of tube 18, which provides a linearly skewed velocity profile such that the core air in tube 18 recirculates back toward the swirler. The strong recirculation created by this device provides exceptional combustion stability for applications where very lean fuel air ratios occur, particularly in transient operation. It is believed that the structure promotes intermixture of air and fuel particles, and prolonged residence time of the mixture in the combustion tube. Combustion is confined to the tube space below opening 26.**

End wall 36 constitutes a diffuser for the fluid moving out of opening 26, and a baffle for confining the combustion within tube 18. Secondary air and cooling air may be introduced into tube 18 through appropriate openings in the tube side wall. In the drawings such openings are shown by reference numerals 44 and 46. Openings 46 are formed by a corrugated wall portion 48 in the peripheral skirt 50 that extends axially from frustro-conical wall 36.

The cross sectional area of tube 18 is preferably much greater than the area of opening 26. In the illustrated device the combustion tube has an area approximately five times the area of opening 26. The tube diameter can be on the order of 5½ inches, and the throat opening 26 diameter can be on the order of 2½ inches.

The axial length of spin chamber 24 (the distance between walls 32 and 34) is preferably substantially less than the diameter of throat opening 26 to ensure that the air has a relatively large circumferential spin component and a relatively small axial flow component. The axial dimension of spin chamber may be on the order of 1⅛ inches, while using a throat 26 diameter of about 2½ inches.

Air is the preferred oxidizer gas, but other oxygen-containing gases can presumably be employed. For convenience the term "air" is used herein to comprehend any suitable oxygen-containing gas.

I wish it to be understood that I do not desire to be limited to the exact details of construction shown and described, for obvious modifications will occur to a person skilled in the art.

I claim:

1. Combustion apparatus for a hot gas turbine, comprising a generally cylindrical combustion tube defining a central axis; spin chamber means coaxial with the combustion tube for supplying a fuel-air mixture thereto; said spin chamber means comprising first and second end walls extending generally normal to the central axis, and a number of evenly spaced spin vanes extending between said end walls for imparting circumferential swirl to pressurized combustion air flowing into the spin chamber from the annular surrounding space; a fuel spray nozzle arranged on the central axis for spraying liquid fuel through the first end wall into the spin chamber so that the sprayed fuel particles intermix with the pressurized air swirling within the chamber; said spin chamber communicating with the combustion tube by means of a circular throat opening formed in the second end wall of the spin chamber coaxial with the combustion tube; said spin vanes extending substantially tangent to an imaginary circle having a diameter approximately equal to that of the circular throat opening, the leading edge of each vane being located outwardly beyond the circular throat opening so that tangential velocity components are generated in the pressurized air before the air is in axial registry with the throat opening; each vane being tilted inwardly toward the spin chamber axis at an angle of about 10°, measured from said second end wall to said first end wall, whereby the air adjacent the first end wall has a smaller spin radius as it leaves the vane trailing edges than the air adjacent the second end wall; each vane having a trapezoidal configuration such that the length of each vane from its leading edge to its trailing edge is greater at the second end wall than at the first end wall, whereby the vanes impart greater spin velocity components to the air adjacent the second end wall than to the air adjacent the first end wall; the greater spin velocity components producing a longer residence time of the air near the second end wall compared to the residence time for the air near the first end wall; the different residence times of the different air streams causing those different streams to reach the plane of the throat opening at about the same time, whereby differential flow velocity turbulence is reduced and air throughput is maintained.

* * * * *